US009545561B2

(12) United States Patent
Edmonston

(10) Patent No.: US 9,545,561 B2
(45) Date of Patent: Jan. 17, 2017

(54) SNOWBOARD SUPPORT DEVICES AND METHODS

(71) Applicant: David Edmonston, Santa Cruz, CA (US)

(72) Inventor: David Edmonston, Santa Cruz, CA (US)

( * ) Notice: Subject to any disclaimer, the term of this patent is extended or adjusted under 35 U.S.C. 154(b) by 0 days.

(21) Appl. No.: 14/827,480

(22) Filed: Aug. 17, 2015

(65) Prior Publication Data

US 2016/0051886 A1 Feb. 25, 2016

Related U.S. Application Data

(60) Provisional application No. 62/039,029, filed on Aug. 19, 2014.

(51) Int. Cl.
*A63C 10/28* (2012.01)
*A63C 7/10* (2006.01)

(52) U.S. Cl.
CPC ..... *A63C 10/28* (2013.01); *A63C 7/1066* (2013.01)

(58) Field of Classification Search
CPC ..... A63C 7/10; A63C 7/1006; A63C 7/12
See application file for complete search history.

(56) References Cited

U.S. PATENT DOCUMENTS

| | | | | |
|---|---|---|---|---|
| 5,156,644 | A | 10/1992 | Koehler et al. | |
| 5,356,168 | A * | 10/1994 | Ozburn | A63C 5/061 280/14.21 |
| 6,220,631 | B1 | 4/2001 | Pritchard et al. | |
| 2002/0175497 | A1 | 11/2002 | Freemon | |
| 2003/0201624 | A1 | 10/2003 | Pascal | |
| 2004/0036257 | A1 | 2/2004 | Lille et al. | |
| 2007/0075524 | A1 | 4/2007 | Kelly | |
| 2012/0007339 | A1 | 1/2012 | Hall | |

FOREIGN PATENT DOCUMENTS

WO WO2004060504 A1 7/2004

OTHER PUBLICATIONS

International Search Report and Written Opinion of the International Searching Authority for PCT/US2015/045497, dated Oct. 26, 2015, 23 pages.

* cited by examiner

*Primary Examiner* — Erez Gurari
(74) *Attorney, Agent, or Firm* — The Marbury Law Group PLLC

(57) ABSTRACT

An apparatus for supporting a board is disclosed. The apparatus includes a support device including a support bar extending beyond the board toward the ground when deployed to provide support to the board.

9 Claims, 17 Drawing Sheets

SNOWBOARD SUPPORT DEVICES AND METHODS

TECHNICAL FIELD

This disclosure relates to apparatuses and methods for supporting a board, and more particularly, to apparatuses and methods for supporting a snowboard.

BACKGROUND

In the sport of snowboarding, the rider must secure his or her boots into the bindings on the board. In most cases, this is done while on the snow, and in most cases this is done after getting off of a chair-lift. Securing the second binding tends to be the most challenging, and often times the rider sits down (e.g., on the snow or a bench) to secure the bindings to avoid falling over. Once on the ground the rider can easily secure the bindings, but then must ultimately stand back up to continue riding. In addition, when securing the bindings, the binding straps tend to fall within the foot-bed area of the binding, interfering the rider placing the boot therein.

SUMMARY

The various embodiments provide devices (or apparatuses) and methods for supporting the rider while the rider secures his or her bindings. The devices and methods described aid the rider's stability on snow, and prevent the rider from tipping over, or needing to sit down to secure the bindings. Further embodiments describe the attachment and operation of the devices as well as methods and devices to keep the binding straps away from the foot-bed area. The disclosed devices and methods enable a rider to put on the snowboard while standing.

In one aspect, an apparatus for supporting a board is disclosed. The apparatus includes a support device including a support bar extending beyond the board toward the ground when deployed to provide support to the board.

In another aspect, a strap retaining device is disclosed. The strap retaining device includes a hinge including at least one piece. The at least one piece is mounted to a binding of a board. The hinge is connected with a strap of the binding. The strap retaining device also includes a spring associated with the hinge and configured to generate a force to rotate the at least one piece of the hinge outwardly away from a foot-bed area of the binding.

In yet another aspect, a method of supporting a rider of a snowboard is disclosed. The method includes providing a support device that includes a support bar mounted to the snowboard, the support bar extending out beyond the snowboard toward the ground to provide support when the rider secures bindings of the snowboard.

BRIEF DESCRIPTION OF THE DRAWINGS

The accompanying drawings, which are incorporated herein and constitute part of this specification, illustrate examples of the disclosed devices and methods, and together with the general description given above and the detailed description given below, serve to explain the features of the invention.

DETAILED DESCRIPTION

The various examples will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

The attached drawings illustrate various exemplary apparatuses and methods for supporting a board, and in particular, for supporting a snowboard. Although snowboards are used as examples of a board, it is understood that the disclosed apparatuses and methods may also be applied to other boards, such as ski boards, skate boards, water surfing/ski boards, etc.

Figure 1A:
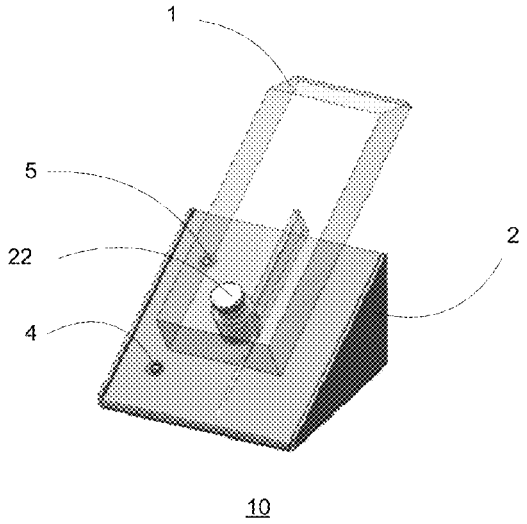
FIGS. 1*a*-1*b* illustrate perspective and partially transparent views of a support device.
Figure 1B:
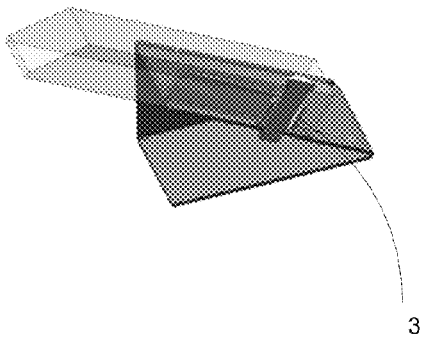
Figure 3A:
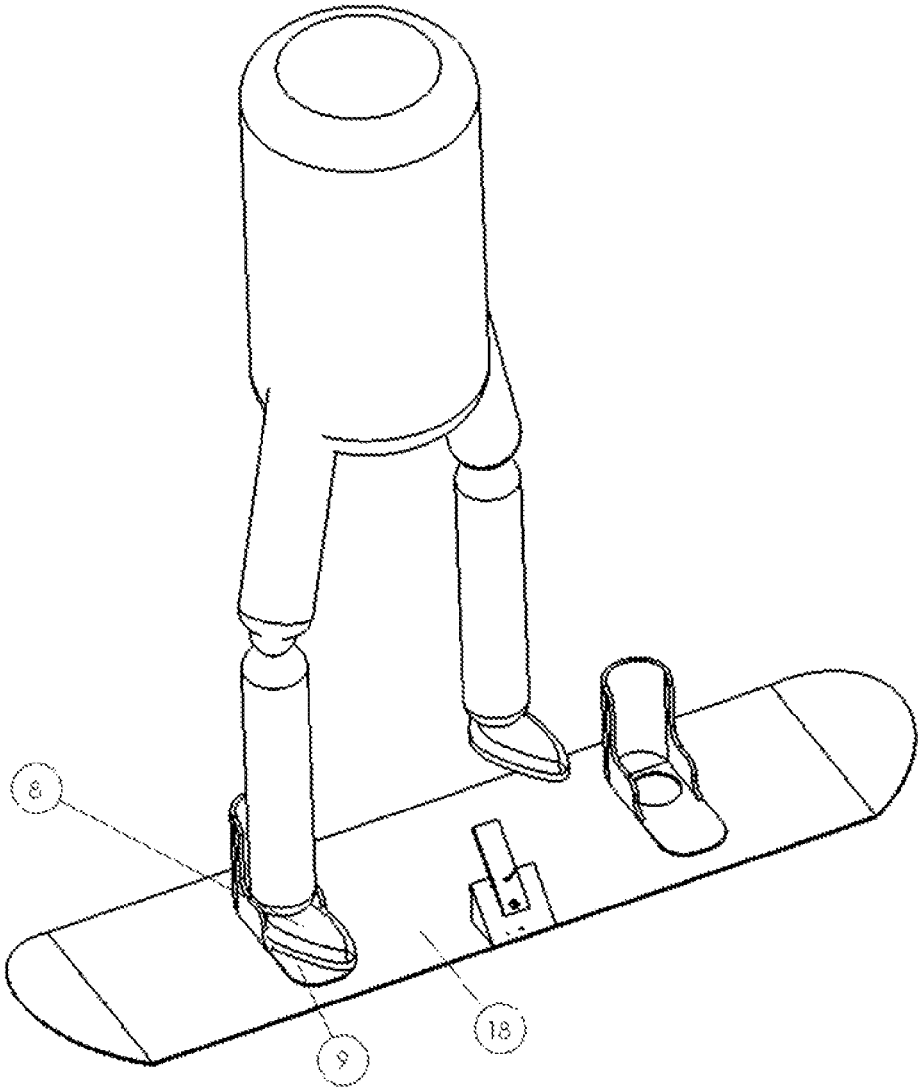
FIGS. 3*a*-3*e* illustrates an exemplary method of operation of a support device when the rider secures bindings of a snowboard.

FIGS. 1*a* and 1*b* show three-dimensional (3D) and partially transparent views of a support device 10, which may be mounted to a board, such as, for example, a snowboard 18 (shown in, e.g., FIG. 3*a*). The support device 10 may include a support bar 1 secured to a mount 2 through a fastening device 22. The support bar 1 may be secured to the mount 2 through various fastening methods, and the fastening device 22 may be any suitable fastening devices. For example, the support bar 1 may be pinned, bolted, or screwed to the mount 2, and the fastening device 22 may be a pin, a bolt, or a screw. It is understood that the term "support bar" should be interpreted broadly to encompass structures of any suitable structures with any suitable shapes or forms that provide support to a board (e.g., the snowboard), such as, for example, a bar, a pin, a bolt, a screw, a rod, a beam, a ball, a triangular structure, a multi-link structure, etc. The support bar 1 may be deployed to provide support to the snowboard 18 when a rider secures bindings of the snowboard 18. The support bar 1 may be made of any suitable material, such as, for example, metal, plastic, composite, wood, or a combination thereof.

The support device 10 may be spring-loaded. For example, the support device 10 may include a spring 3 (e.g., a torsion spring 3) for securing the support bar 1 to the mount 2 and for retaining the support bar 1 at a position (e.g., a riding position 5) through a force generated by the spring 3. The mount 2 shown in FIGS. 1*a* and 1*b* has a slant surface with an angle with respect to a surface of the snowboard 18 when the mount 2 is mounted to the surface of the snowboard 18. The support bar 1 may be mounted to the slant surface of the mount 2 through the fastening device 22. The mount 2 may be fastened to the snowboard 18 via any suitable methods, such as by bolts, screws, pins, welding, gluing, etc. The mount 2 may be made of any suitable material, such as, for example, metal, plastic, composite, wood, or a combination thereof, and may be in any shape or form.

The support bar 1 may be rotated around the fastening device 22 on the slant surface of the mount 2. When the support bar 1 is not deployed to provide support to the snowboard 18, the support bar 1 may be positioned at a riding position 5 (shown in, e.g., FIGS. 1*a*, 1*b*, 2, 3*a*, 3*e*), pointing upward toward a rider, away from the surface of the snowboard and the ground. The support bar 1 may be retained at the riding position 5 by the force generated by the torsion spring 3. When the support bar 1 is used to provide support to the snowboard 18, the support bar 1 may be rotated around the fastening device 22, from the riding position 5 to a supporting position 4 (shown in, e.g., FIGS. 3*b*, 3*c*, *d*), pointing downwardly toward the ground. The slant surface with an angle allows the support bar 1 to overhang the snowboard 18 when in the supporting position 4, and then retract (e.g., rotate) back to the riding position 5. The support bar 1 may be rotated by a human force (e.g., by the rider) around the fastening device 22 between the supporting position 4 and the riding position 5. At the support position 4, the support bar 1 may extend downwardly, pointing to the ground, and out of an edge of the snowboard 18. When a rider stands on the snowboard 18 to secure the bindings, the support bar 1, which penetrates the snow/ice, may provide additional support to the snowboard 18 and the rider. When the support bar 1 is rotated from the riding position 5 to the supporting position 4, the torsion spring 3 may generate a force resisting the rotation. As a result, once the support bar 1 is released from the supporting position 4, the torsion spring 3 may force the support bar 1 to rotate back to the riding position 5.

Figure 2:
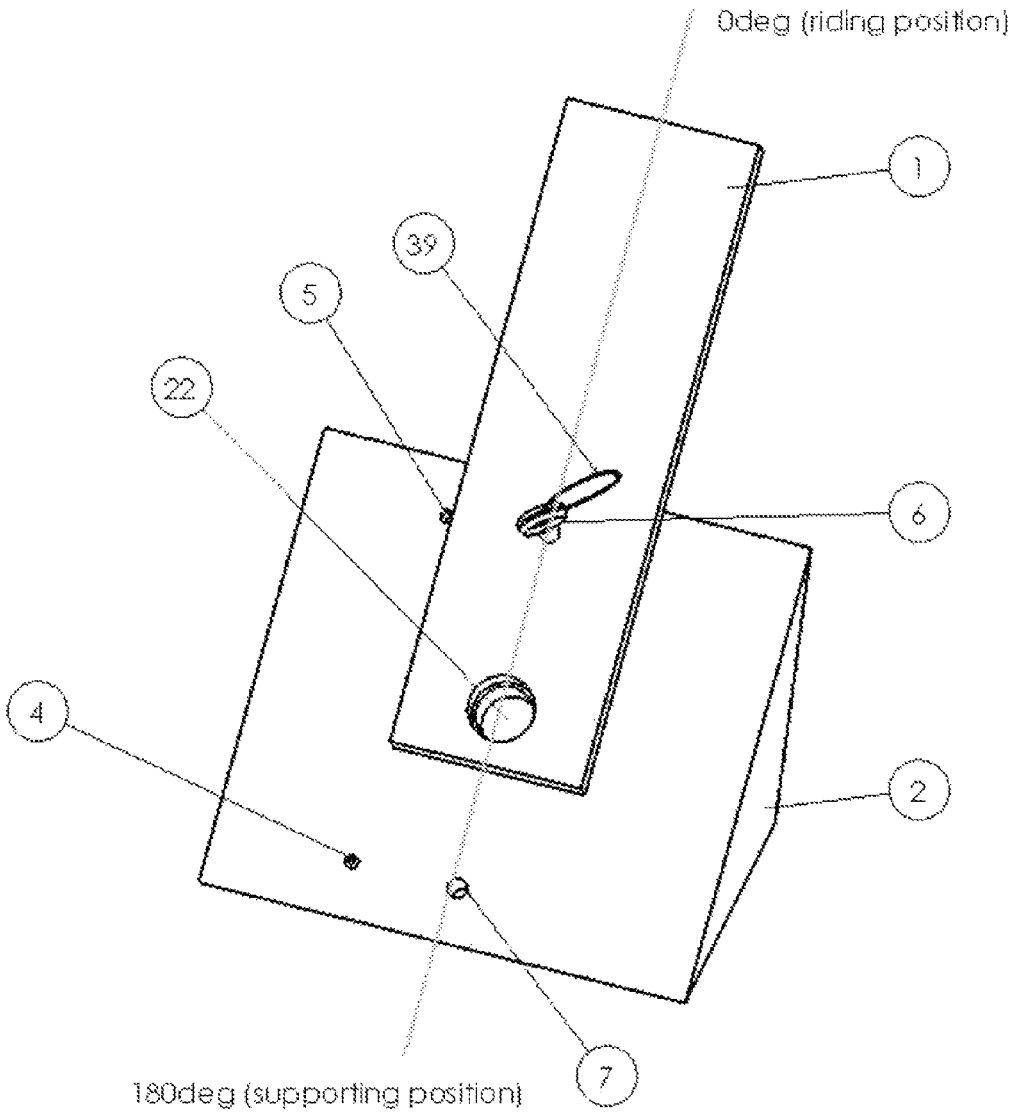
FIG. 2 illustrates a support device including a locking mechanism.

The support device 10 may include a locking mechanism to lock the support bar 1 in at least one of the supporting position 4 or the riding position 5. FIG. 2 shows the support device 10 with an example locking mechanism. The locking mechanism may include a spring loaded pin 6 provided on the support bar 1 and a locking structure 7 provided on the mount 2. The spring loaded pin 6 may be attached to the support bar 1 at a suitable location. For example, the spring loaded pin 6 may be located in the middle portion of the support bar 1, and may extend perpendicularly throughout the top surface and the bottom surface of the support bar 1. An internal spring (not shown) of the spring loaded pin 6 may exert a force to push or pull the pin downwardly toward the surface of the mount 2, on which the support bar 1 is mounted.

Referring to FIG. 2, the locking structure 7 may be configured to receive one end of the spring loaded pin 6. When the support bar 1 is rotated about 180 degrees from the riding position 5 to the supporting position 4, the spring loaded pin 6 may lock into (e.g., engage with) the locking structure 7 (e.g., a hole, cavity, or a cylinder with an inner volume) included in the mount 2, thereby securing the support bar 1 at the supporting position 4. When the spring loaded pin 6 is disengaged from the locking structure 7, the support bar 1 may be rotated back to the riding position 5 by the force generated by the torsion spring 3, and be held in the riding position 5 by the torsion spring 3. Although not shown, it is understood that a similar additional locking structure may be provided on the surface of the mount 2 to engage with the spring loaded pin 6 to lock the support bar at the riding position 5.

Still referring to FIG. 2, the spring loaded pin 6 may include a ring 39 at a top end. When the spring loaded pin 6 is engaged with the locking structure 7 at the supporting position 4, the rider may disengage the spring loaded pin 6 from the locking structure 7 by pulling the ring 39, thereby pulling up the spring loaded pin 6. In some examples, the ring 39 may be omitted, and the rider may pull the top head portion of the spring loaded pin 6 to disengage the spring loaded pin 6 from the locking structure 7. The mount 2 may include other similar structures and/or features that allow spring assisted operation as described above.

Figure 3B:
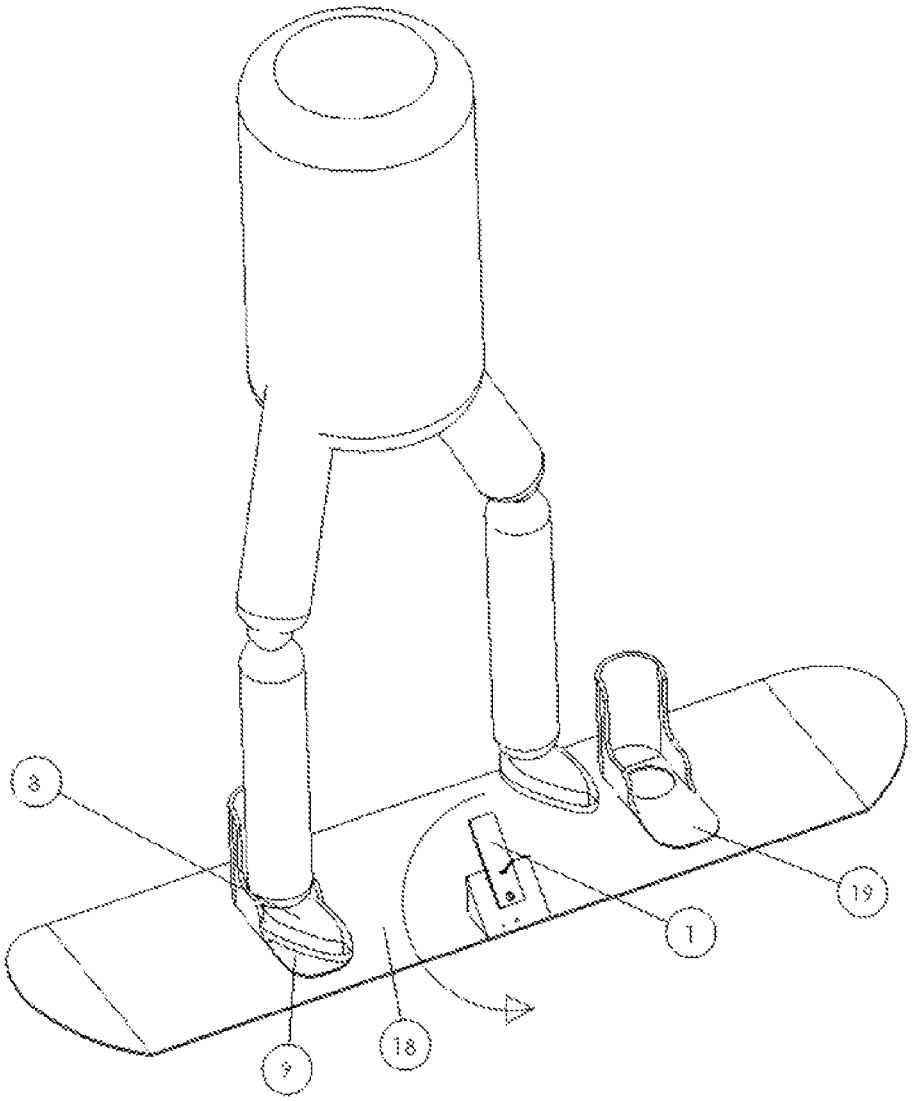
Figure 3C:
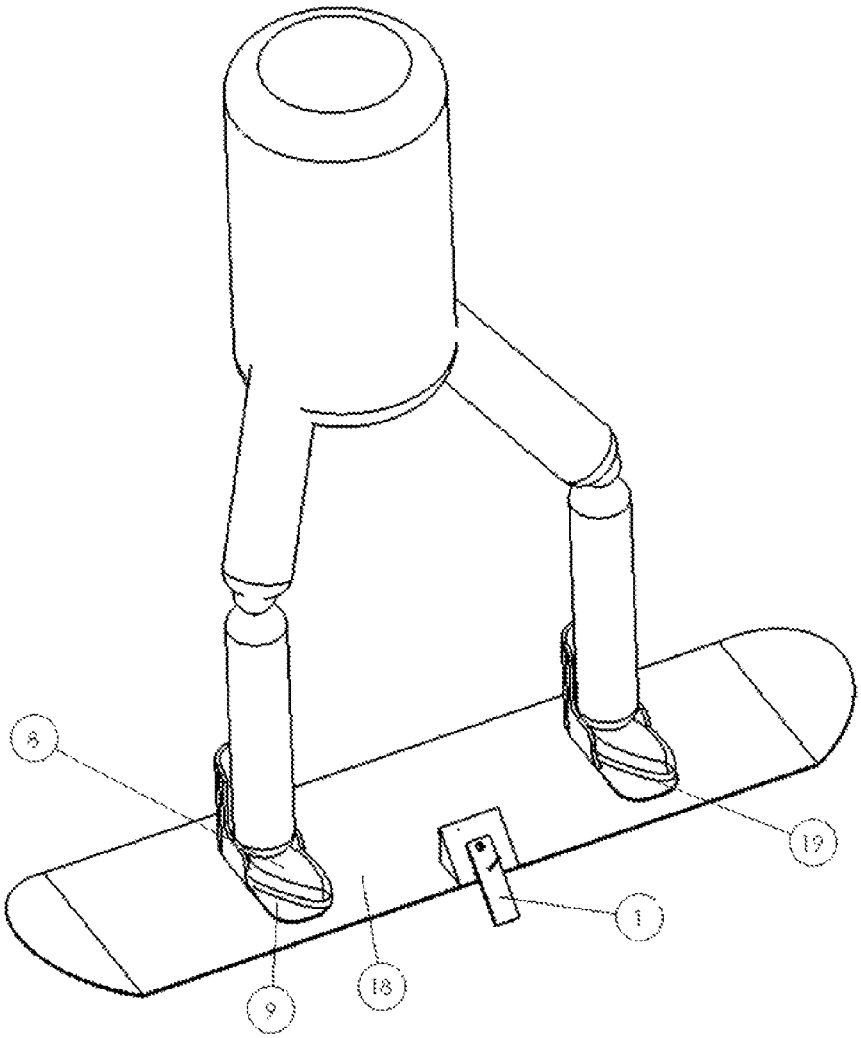
Figure 3D:
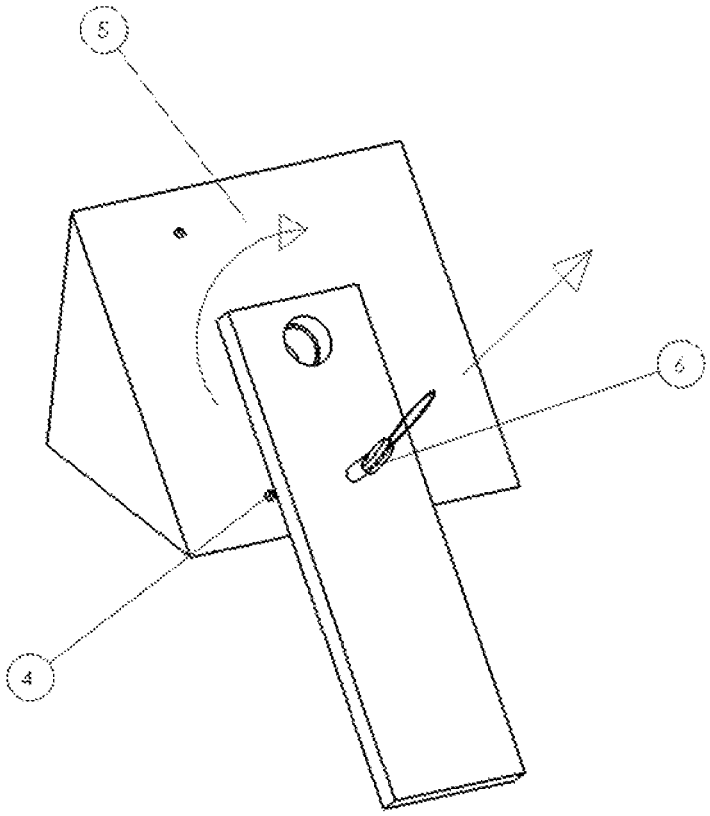
Figure 3E:
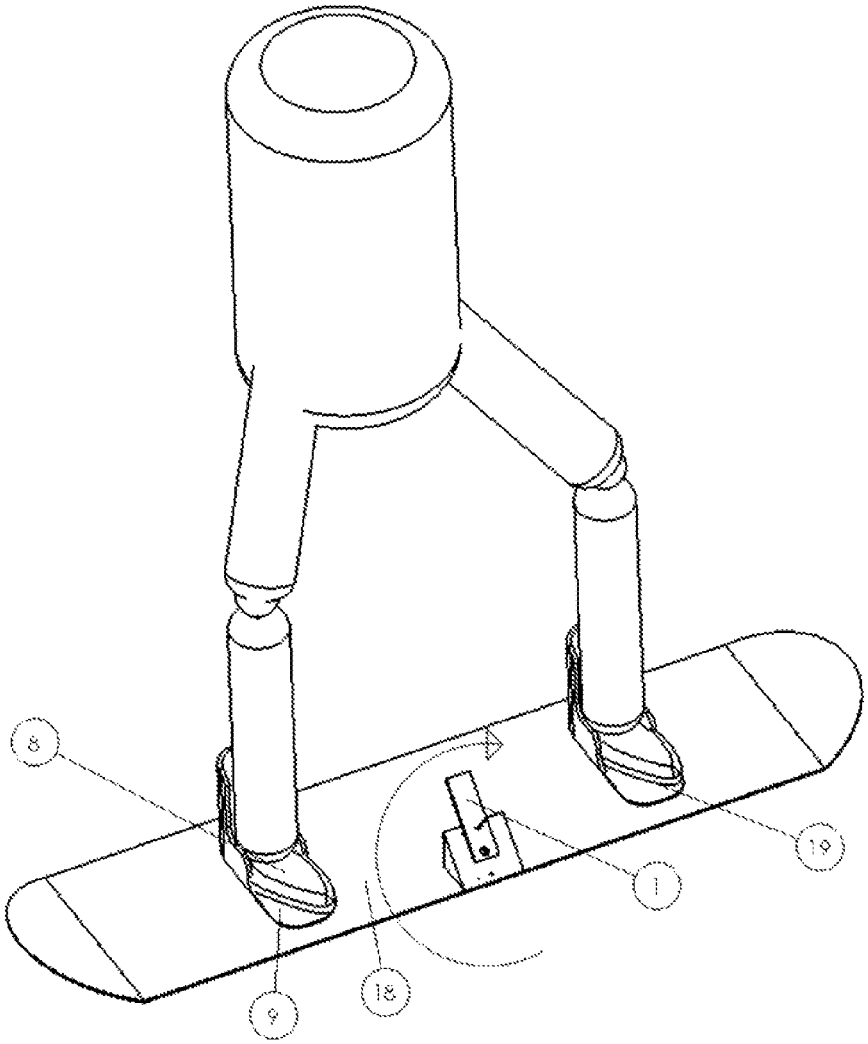

FIGS. 3*a*-3*e* illustrate an exemplary method of operation of the support device 10 when the rider secures the bindings of the snowboard 18. In one example, the rider has one boot 8 already secured to a first binding 9 of the snowboard 18, as in the case of when the rider leaves the chair lift. The rider then reaches down and rotates the support bar 1 (e.g., by hand) from the riding position 5 to the supporting position 4, where the spring loaded pin 6 engages with (e.g., locks into) the locking structure 7, as shown in FIG. 3*b*. When the spring loaded pin 6 engages with the locking structure 7, the spring loaded pin 6 and the locking structure 7 hold the resisting torsional force exerted by the torsion spring 3, thereby preventing the support bar 1 from snapping back into the riding position 5. When the support bar 1 is locked in place in the supporting position 4, it protrudes (e.g., extends) out of the snowboard 18 toward the ground and penetrates into the snow to provide additional support to stabilize the snowboard 18, when the rider secures a second binding 19. With the additional support provided by the support bar 1, the rider may avoid tipping over when securing the second binding 19, which often occurs when no support device is provided on the snowboard. The rider may reach down and secure the second binding 19 on the snowboard 18. The rider then pulls up the ring 39 to disengage the spring loaded pin 6 from the locking structure 7, at which point the torsional force of the torsion spring 3 causes the support bar 1 to rotate back into the riding position 5.

Figure 8:
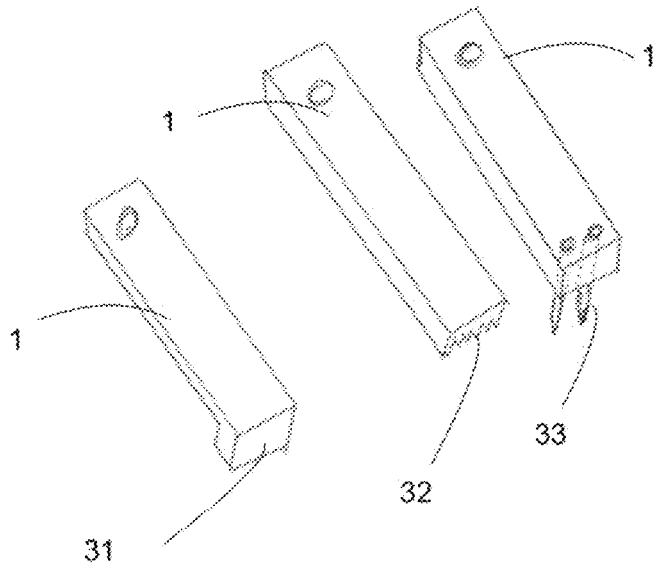
FIG. 8 illustrates snow-gripping features that may be included in a support device.

The support bar 1 may include structures, features, and/or textures to aid in gripping the snow (hereinafter "snow gripping structures") as shown in FIG. 8. In one example, the support bar 1 may include a snow gripping structure, such as a protruding bar 31, extending from one end of the support bar 1 toward the ground (e.g., snow). In another example, the support bar 1 may include a snow gripping structure, such as a sawtooth shaped piece 32, extending from one end of the support bar 1 toward the ground. In yet another example, the support bar 1 may include a snow gripping structure, such as one or more nails 33 extending from one end of the support bar 1 toward the ground. It is understood that the snow gripping structures, features, and/or textures may also be included in other examples of support bars described in other figures.

Figure 4A:
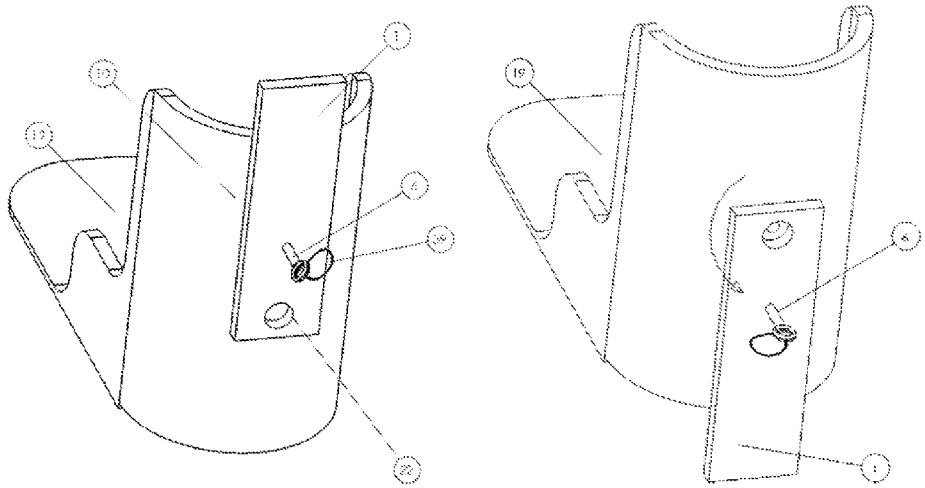
FIGS. 4*a*-4*c* illustrate a support device mounted to or integrated in a binding.
Figure 4B:
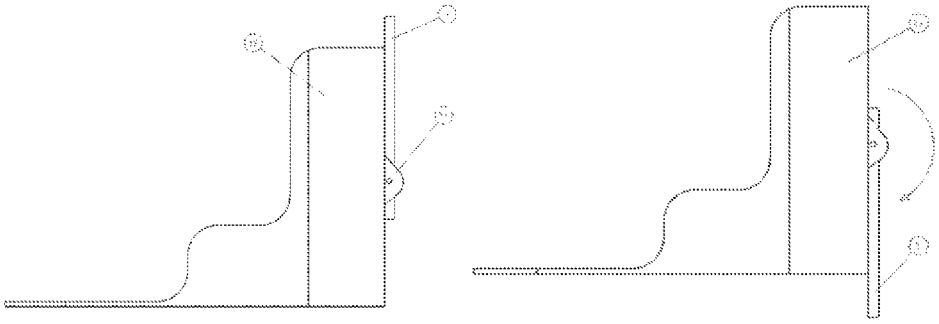
Figure 4C:
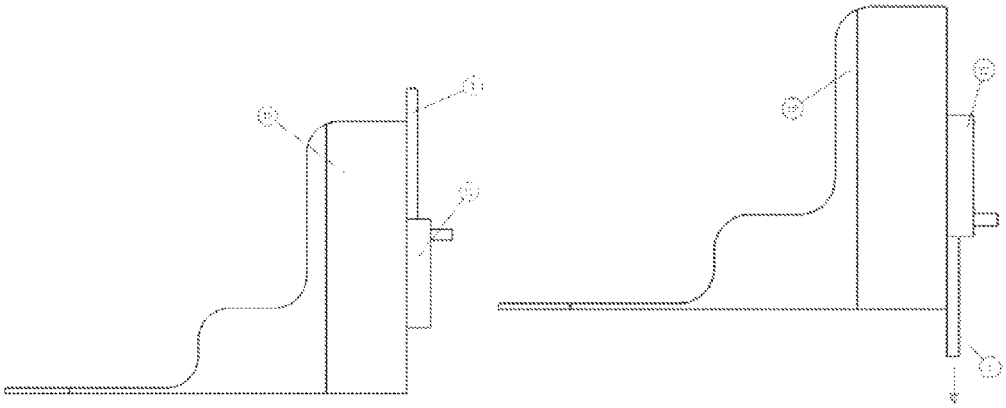

The support device 10 may be mounted to or integrated in a binding. As shown in FIGS. 4*a*-4*c*, the support device 10 may be mounted to or integrated in the back portion of a binding. It is understood that the support device 10 may also be mounted to or integrated in other portions (e.g., side portions) of the binding. In addition, in some examples, more than one support device 10 may be mounted to or integrated in the binding. When mounted to or integrated in the binding, the support device 10 may include the same or similar elements (e.g., pin 22, locking structure 7, spring loaded pin 6, support bar 1, etc.) as those described above in connection with FIGS. 1-3 and 8. For example, in the example shown in FIG. 4*a*, the same or similar structures as those shown in FIG. 2 may be implemented. The support device 10 shown in FIG. 4*a* may include the support bar 1, the pin 22, the spring loaded pin 6, and the locking structure 7 (not shown, which may be located below the pin 22 on the binding 19). The support bar 1 may be mounted to the binding 19 through the pin 22, which may also be other suitable fastening devices, such as a bolt, a screw, etc., as described above. The support bar 1 may be rotated around the pin 22 between a riding position (pointing upwardly) and a supporting position (pointing downwardly). When the support bar 1 is rotated to the supporting position, the spring loaded pin 6 located in the support bar 1 may engage with the locking structure 7 (not shown), thereby locking the support bar 1 in the supporting position. The support bar 1 may provide additional support to the rider when the rider secures the bindings on the snowboard. With the support bar 1 standing in the snow, the snowboard may be more stable when the rider secures the bindings. After the rider secures the bindings, the rider may pull the ring 39 to release the spring loaded pin 6 from the locking structure 7 (not shown). The rider may rotate the support bar 1 to the riding position, or a torsion spring (not shown) coupled with the support bar 1 may force the support bar 1 to rotate from the supporting position to the riding position. A suitable locking mechanism may be included to lock the support bar 1 in the riding position. In some examples, the binding 19 may include a second locking structure 7 or a similar locking structure located above the pin 22, which may engage with the spring loaded pin 6 to lock the support bar 1 in the riding position.

In some examples, the support device 10 may also be mounted to the binding (e.g., binding 19) using a hinge 11, as shown in FIG. 4*b*. In this example, the support bar 1 may be positioned upwardly when in the riding position, and may be flipped (e.g., rotated) down around the hinge 11 to point downwardly toward the ground (e.g., snow) when in the supporting position. The hinge 11 may or may not be associated with a spring. In some examples, the hinge 11 may be associated with a torsion spring (not shown). The force exerted by the torsion spring may retain the support bar 1 at the riding position. The force exerted by the torsion spring may resist the rotation of the support bar 1 from the riding position to the supporting position. Accordingly, the support device 10 may include a suitable locking mechanism (not shown in FIG. 4*b*), including the locking mechanisms described above, to lock the support bar 1 in the supporting position. When the locking mechanism is disengaged, the support bar 1 may be rotated back to the riding position by the force exerted by the torsion spring. In the examples where the hinge 11 is not associated with a torsion spring, the support bar 1 may be rotated back to the riding position by the rider. In the examples where the hinge 11 is not associated with a torsion spring, a suitable locking mechanism may also be included to lock the support bar 1 in the supporting position.

In some examples, the support device 10 may be mounted to or integrated in the binding (e.g., binding 19) and be linearly activated by a spring loaded pin 12, as shown in FIG. 4*c*. The support bar 1 may include a plurality of holes or cavities (not shown) on the support bar 1. The spring loaded pin 12 may engage with the plurality of holes on the support bar 1 to define various positions of the support bar 1. When not deployed to support the binding 19 and the snowboard 18, the support bar 1 may be retracted up to the riding position, as shown in FIG. 4*c*. The spring loaded pin 12 may engage with a hole in the support bar 1 to secure the support bar 1 in the riding position. When the support bar 1 is to be used to support the binding 19 and the snowboard 18, the support bar 1 may be extended down (e.g., pushed or pulled down) toward the ground (e.g., snow) to penetrate through the snow/ice, as shown in FIG. 4*c*, while the spring loaded pin 12 is operated (e.g., pulled away from the binding by the rider) to disengage the spring loaded pin 12 from any hole in the support bar 1. When the support bar 1 reaches a desired supporting position, the spring loaded pin 12 may be released to engage with a hole in the support bar 1 to secure the support bar 1 at the supporting position.

Figure 5A:
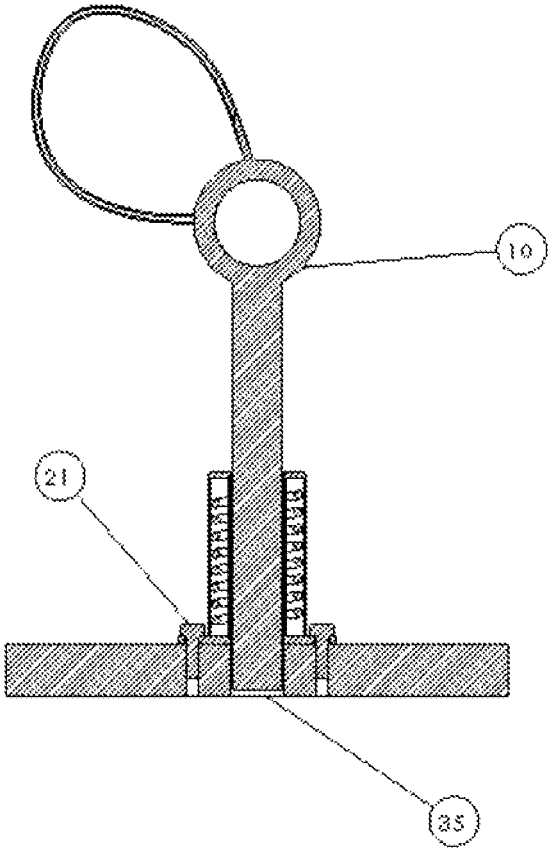
FIGS. 5*a*-5*b* illustrate a support device with a supporting end of a support bar extending through a cavity of a snowboard.
Figure 5B:
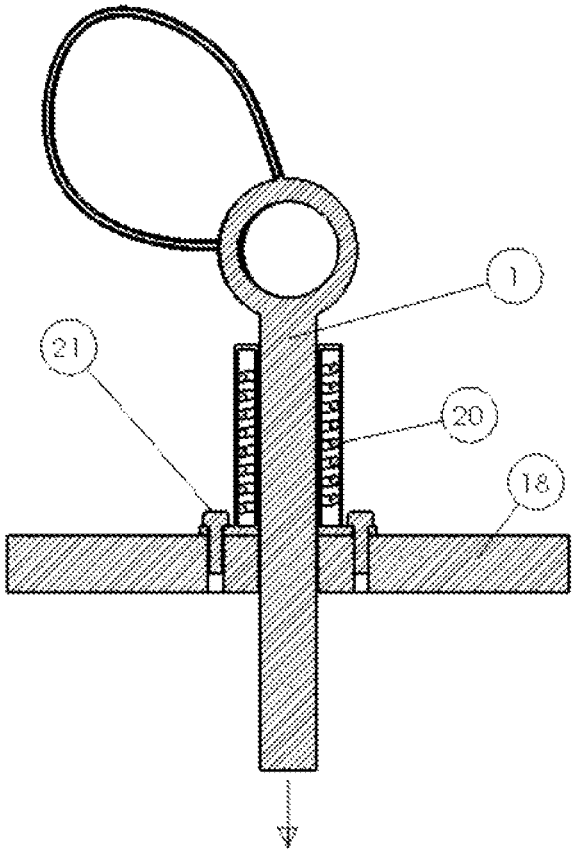

It is possible to make the support device 10 compact by enabling the support bar 1 to penetrate through a hole, cutout, or cavity 35 in the snowboard 18, as shown in FIGS. 5*a*-5*b*. In this example, the support device 10 may include a linearly actuated support bar 1 (e.g., a pin) that may engage with a compression spring 20. The support device 10 may be bolted, glued, or otherwise fastened to the snowboard 18. In the example shown in FIGS. 5*a*-5*b*, the support device 10 is fastened to the snowboard 18 using one or more bolts 21. When in the riding position shown in FIG. 5*a*, the support bar 1 is not extended through the cavity 35 below the snowboard 18. The support bar 1 may be retained at the riding position by the force generated by the compression spring 20. To place the support bar 1 in the supporting position, the support bar 1 may be pushed or pulled downwardly such that one end of the support bar 1 penetrates through the cavity 35 to extend out of and underneath the snowboard 18 (e.g., throughout the hole 35) to provide support for the snowboard 18, as shown in FIG. 5*b*. A suitable locking mechanism, including one of those discussed above, may be used to lock the support bar 1 in the supporting position. When the locking mechanism is disengaged, the support bar 1 may be retracted from the supporting position back to the riding position by the force generated by the compression spring 20. It is understood that the example shown in FIGS. 5*a*-5*b* may also be implemented in other examples, e.g., those shown in FIGS. 4*a*-4*c*, where the support bar is mounted to the binding.

Figure 6A:
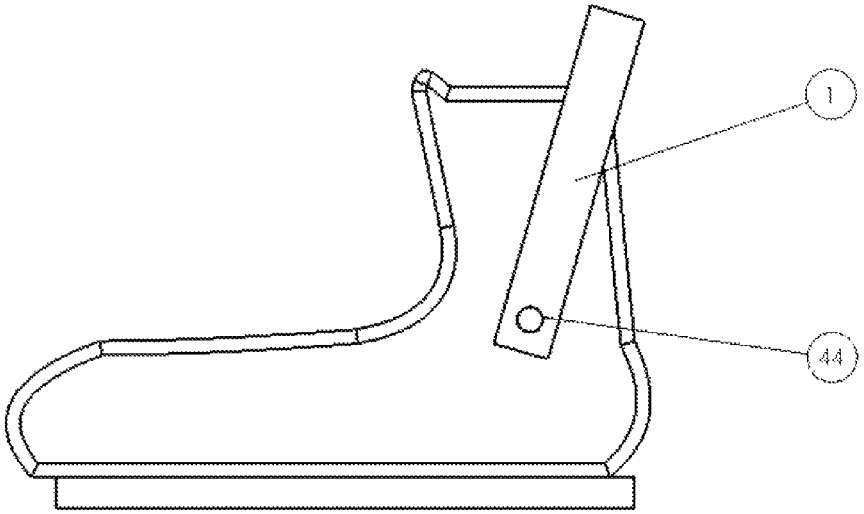
FIGS. 6*a*-6*b* illustrate a support device including a support bar mounted to a boot of a rider.
Figure 6B:
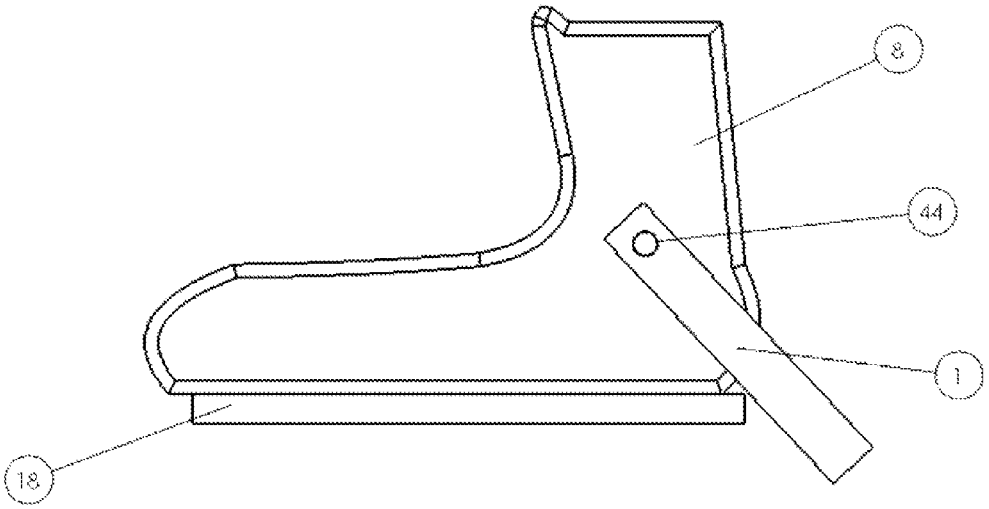

The support device 10 that includes the support bar 1 may also be mounted to a boot 8 of the rider, as shown in FIGS. 6*a*-6*b*. The support bar 1 may be mounted to the boot 8 through any suitable mechanism, such as a pin 44. The pin 44 may be any other suitable fastening devices, such as a bolt, a hinge, a screw, etc. The support bar 1 may rotate around the pin 44 between the riding position (pointing upwardly) and the supporting position (pointing downwardly to the ground). The pin 44 may or may not be associated with a spring (i.e., the pin 44 may or may not be spring loaded). When the pin 44 is spring loaded with a spring (such as a torsion spring, not shown), the force generated by the spring may retain the support bar 1 at the riding position. The force generated by the spring may resist the rotation of the support bar 1 from the riding position to the supporting position. Accordingly, the support device 10 may include a suitable locking mechanism to lock the support bar 1 in the supporting position. When the locking mechanism is disengaged, the support bar 1 may be rotated back from the supporting position to the riding position by the force generated by the spring associated with the pin 44. Other features, such as the snow gripping structures described above may also be included in the example shown in FIGS. 6*a*-6*b*.

Figure 7:
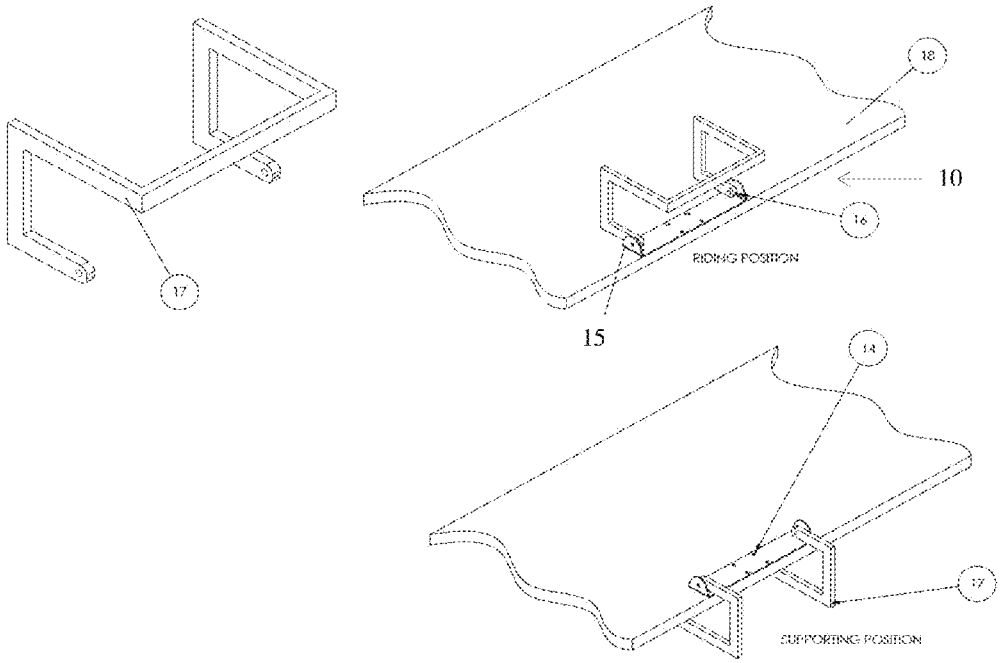
FIG. 7 illustrates a support device mounted to a binding area of a snowboard.

FIG. 7 shows another example support device 10. The support device 10 may include a support bar 17. The support bar 17 may include a multi-link shape including more than one linkage, such as, for example, angled bars or rods, one example of which is shown in FIG. 7. The support device 10 including the support bar 17 may be mounted to a mount 15, which may be located underneath a binding. The mount 15 may be attached to the snowboard 18 through one or more binding screws 14. The mount 15 may include at least one torsion spring 16 on one or both sides of the mount 15. In the example shown in FIG. 7, both sides of the mount 15 include a torsion spring 16. The torsion springs 16 may be attached to the support bar 17 and the force generated by the torsion springs 16 may retain the support bar 17 in the riding position, when the support bar 17 is not deployed to support the snowboard 18. In the riding position, the support bar 17 is locked into place above the snowboard 18. In the supporting position, the support bar 17 is locked into place over the edge of the snowboard 18, and/or underneath the snowboard 18, as shown in FIG. 7. Once the rider secures both bindings, the rider may manually cause the support bar 17 to start rotating upward, and the support bar 17 may be forced back over the snowboard 18 (the riding position) by the force generated by the torsion springs 16. For example, the rider may pull the support bar 17 upwardly away from the supporting position until the force generated by the torsion springs 16 pulls back the support bar 17 automatically to the riding position. Alternatively or additionally, the rider may turn his foot to cause the support bar 17 to start rotating upwardly away from the supporting position. The support device 10 may or may not include a locking mechanism to lock the support bar 17 in the supporting position. In some examples, a suitable locking mechanism, including one of the locking mechanisms discussed above, may be included in the support device 10 to lock the support bar 17.

Figure 9A:
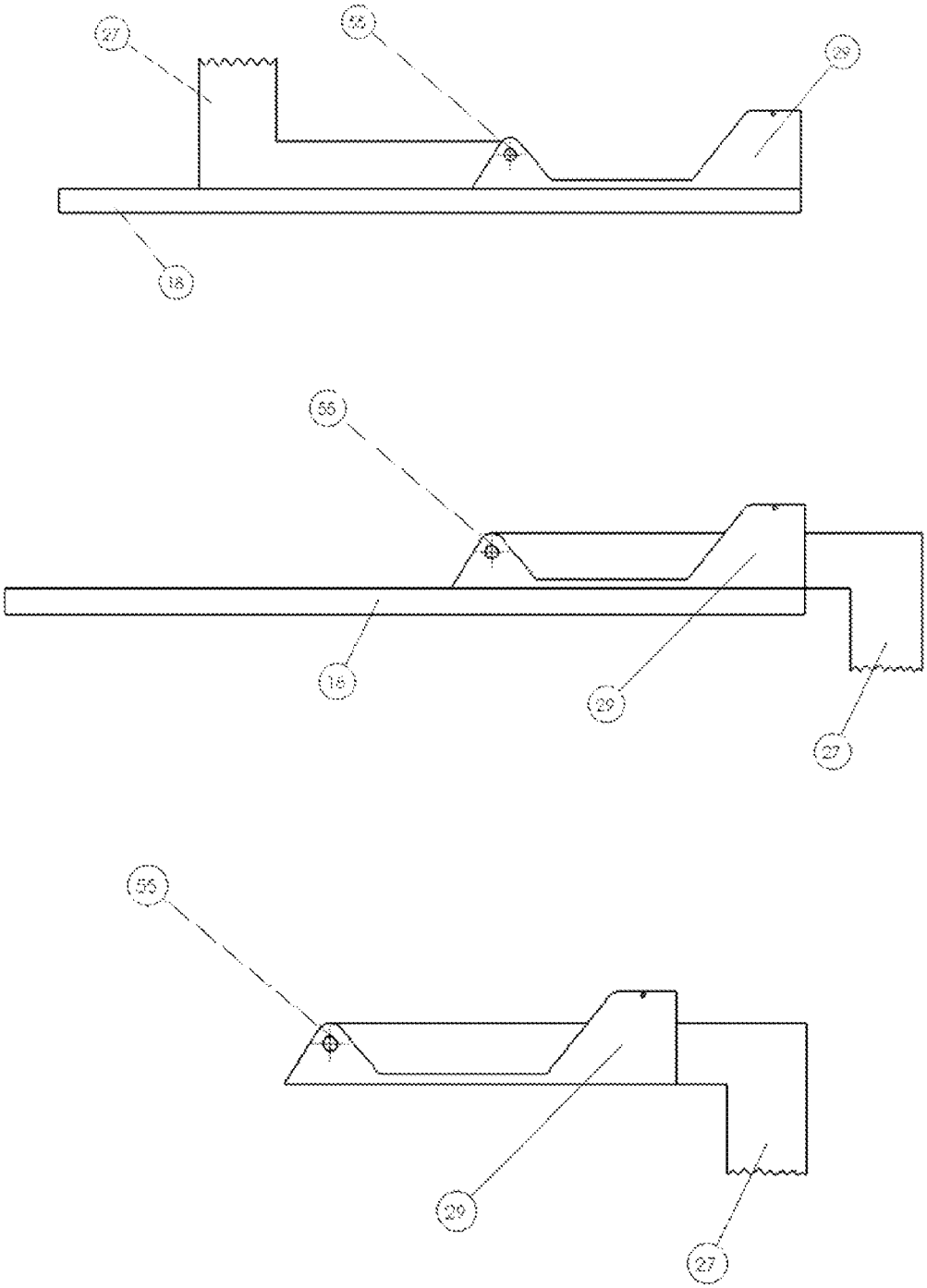
FIG. 9*a* illustrates a support device mounted to a snowboard having a rotating mechanism.
Figure 9B:
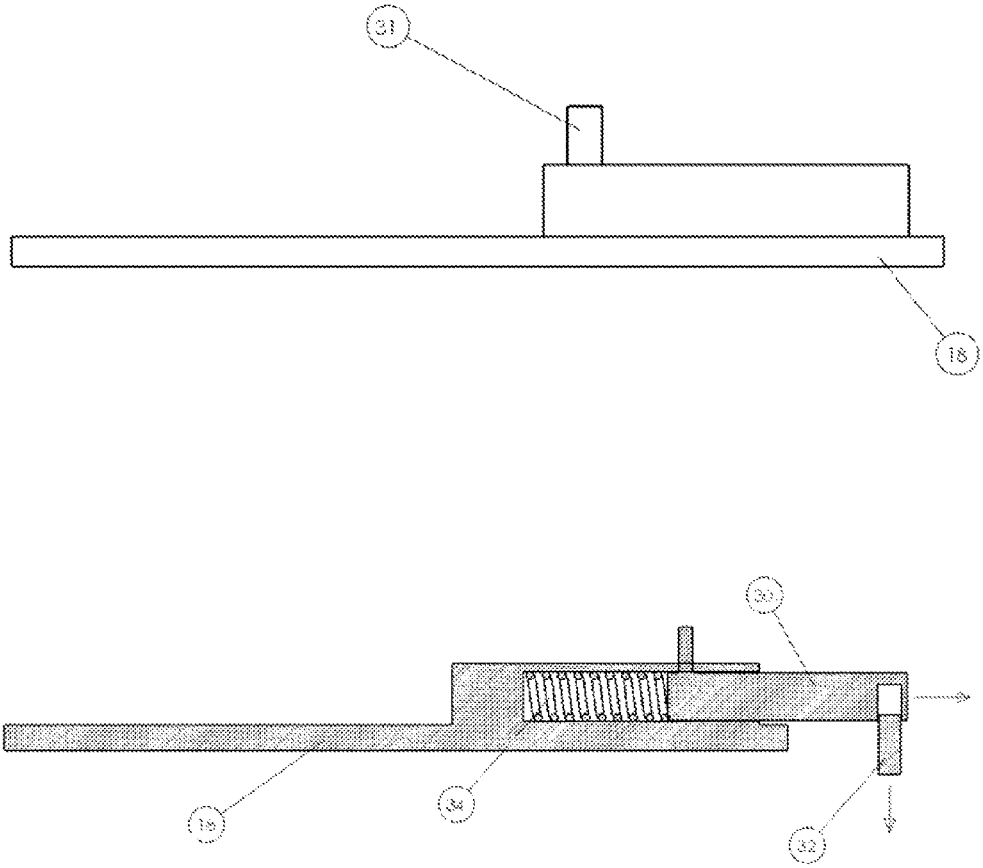
FIG. 9*b* illustrates a support device mounted to a snowboard having a sliding mechanism.

The support device 10 may also be mounted on the surface of the snowboard 18, as shown in FIGS. 9*a* and 9*b*. FIG. 9*a* shows the support device 10 including a rotating mechanism, and FIG. 9*b* shows the support device 10 including a sliding mechanism. The support device 10 (including the rotating mechanism or the sliding mechanism) may be mounted on the surface of the snowboard 18 close to an edge of the snowboard 18. In the support device 10 shown in FIG. 9*a*, the support device 10 includes a spring 28 (e.g., a torsion spring 28) holds a support bar 27 in the riding position. The support bar 27 may include structures and/or features similar to the support bar 1 and/or support bar 17 described above, including, for example, the snow gripping structures described above. In some examples, the support bar 27 is shaped such that it overhangs the edge of the snowboard 18. The support bar 27 may be rotated around an axis 55 provided above and adjacent the surface of the snowboard 18 (e.g., an axis of a hinge mounted on the snowboard 18) from the riding position to the supporting position. The spring 28 may share the axis 55 with the support bar 27. At the supporting position, the support bar 27 may extend outside of the edge of the snowboard 18. An end of the support bar 27 may extend toward the ground, thereby penetrating snow/ice to provide support to the snowboard 18. The support bar 27 may be locked at the supporting position by a quick release mechanism 29 mounted on the snowboard 18. When the quick release mechanism 29 is released and the support bar 27 is unlocked from the supporting position, the support bar 27 may be rotated back to the riding position by the force generated by the spring 28. Alternatively or additionally, the rider may rotate the support bar 27 back to the riding position.

The support device 10 shown in FIG. 9*b* may include a sliding mechanism. The support device 10 may include a support bar 30. The support bar 30 may include the same or similar structures and/or features as support bar 1, 17, or 27 described above, including the snow gripping structures describe above. The support device 10 may include a spring 34 that holds the support bar 30 in the riding position. The support device 10 may include a handle 31 that allows the rider to slide the support bar 30 into the supporting position. The support bar 30 may be slid along a rail (not shown) mounted on the surface of the snowboard 18 or slid directly on the surface of the snowboard 18. In either configuration, the support bar 30 is slidable along the surface of the snowboard 18 between the riding position and the supporting position. When the support bar 30 is slid into the supporting position, the spring 34 is stretched, and thus, generates a force resisting the movement of the support bar 30 from the riding position to the supporting position. A locking mechanism (not shown) may lock the support bar 30 in the supporting position. The locking mechanism may include any suitable locking mechanism, for example, any locking mechanism described above, or any other locking mechanism known in the art. The support bar 30 may include a snow gripping structure or feature 32, which may be any form or shape, such as, for example, a bar, a rod, a sawtooth structure, a nail, etc. The snow gripping structure 32 may include other snow gripping structures and/or features described above in connection with, e.g., FIG. 8. The snow gripping structure 32 may be spring activated past the edge of the snowboard 18. The snow gripping structure 32 may extend out of and below the snowboard 18, penetrating into the snow/ice, to provide support for the snowboard 18. Any suitable mechanism known in the art may be used to spring activate the snow gripping structure 32. After the rider secures the bindings, the snow gripping structure 32 may be retracted (e.g., pushed back into the support bar 30), and the support bar 30 may be slid back (e.g., pushed back) to the riding position.

Figure 10:
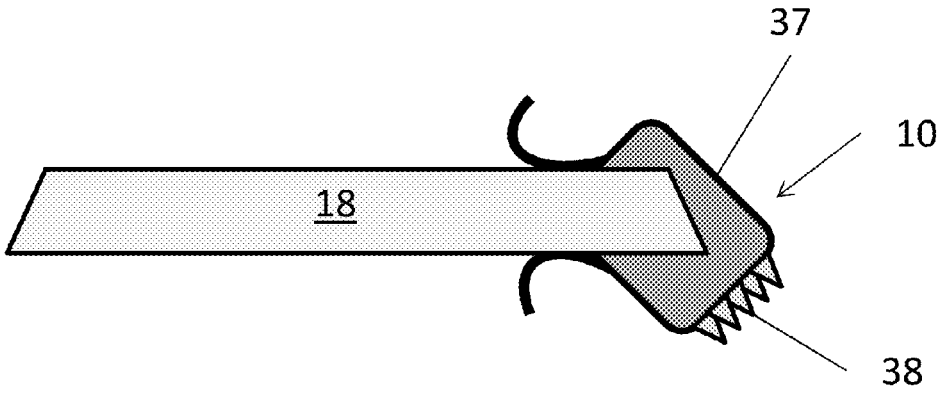
FIG. 10 illustrates a support device that wraps around an edge of a snowboard.

In some examples, the support device 10 may include a support bar 37 that may wrap around the edge of the snowboard 18, as shown in FIG. 10. In this example, the support bar 37 may be clipped onto the snowboard 18 where it pinches the top and bottom surface of the snowboard 18. The support bar 37 may take the form of a sheet. The support bar 37 may take the form of a bar with a hollow center to accommodate a portion of the snowboard 18 when the support bar 37 is clipped to the upper and lower surfaces of the snowboard 18. The support device 10 may include one or more snow gripping structures and/or features 38, which may be similar to those snow gripping structures and/or features described above (e.g., those shown in FIG. 8). In some examples, the support device 10 may be clipped onto the rider's binding, boot, snowboard, goggles, helmet, or any other feature, or it may be handheld and carried in pockets. The support device 10 may also include a lanyard, cord, rope, or other suitable mechanism to secure the support device 10 to the snowboard, binding, or boot, etc. In one example, the support device 10 may be removed from the snowboard 18 when not used to support the snowboard 18, and may be snapped onto the snowboard 18 when used to support the snowboard 18.

The preceding description of the disclosed aspects is provided to enable any person skilled in the art to make or use the present invention. Various modifications to these aspects will be readily apparent to those skilled in the art, and the generic principles defined herein may be applied to other aspects without departing from the scope of the invention. Thus, the present invention is not intended to be limited to the aspects shown herein but is to be accorded the widest scope consistent with the principles and novel features disclosed herein. It is intended that the specification and examples be considered as exemplary only, with a true scope being indicated by the following claims and their equivalents.

What is claimed is:

1. An apparatus for supporting a board, comprising:

a mount disposed on the board; and a support bar connected to the mount and configured to move between a riding position, and a supporting position where the support bar extends underneath below the board toward the ground to provide support to the board;

wherein:

the board is a snowboard;

the support bar is configured to rotate between the riding position and the supporting position;

in the riding position, substantially all or all of the support bar is disposed above the board; and the support bar begins to rotate upwardly away from the supporting position to the riding position in response to a turn of a foot of a rider of the snowboard;

wherein the mount further comprises a torsion spring which generates a force to rotate the support bar around an axis to the riding position.

2. The apparatus of claim 1, further comprising a locking mechanism configured to secure the support bar in the support position.

3. The apparatus of claim 1, wherein the mount is attached to an upper surface of the snowboard.

4. The apparatus of claim 3, wherein the support bar is attached to the mount through at least one of a bolt, screw, or pin.

5. The apparatus of claim 3, wherein the support bar is attached to the mount through a hinge.

6. The apparatus of claim 1, wherein the support bar has a multi-link shape.

7. The apparatus of claim 1, wherein the mount is mounted to one or more binding screws located in the board.

8. The apparatus of claim 7, wherein the support bar is rotatable around an axis provided above and adjacent the surface of the board.

9. The apparatus of claim 1, wherein in the support position, the support bar wraps around an edge of the board.

* * * * *